US008487200B2

(12) United States Patent
Yang et al.

(10) Patent No.: US 8,487,200 B2
(45) Date of Patent: Jul. 16, 2013

(54) STRUCTURE FOR OPERATING PIVOT SWITCHES OF MULTI-FUNCTION SWITCH ASSEMBLY

(75) Inventors: Dae Yeon Yang, Gwangju (KR); Ki Won Kim, Gwangju (KR); Jong Rog Kim, Gwangju (KR)

(73) Assignee: Alps Electric Korea Co., Ltd, Gwangju (KR)

( * ) Notice: Subject to any disclaimer, the term of this patent is extended or adjusted under 35 U.S.C. 154(b) by 276 days.

(21) Appl. No.: 13/158,400

(22) Filed: Jun. 11, 2011

(65) Prior Publication Data

US 2011/0308927 A1 Dec. 22, 2011

(30) Foreign Application Priority Data

Jun. 22, 2010 (KR) ..... 10-2010-0058959

(51) Int. Cl.
*H01H 13/70* (2006.01)

(52) U.S. Cl.
USPC ..... 200/5 A

(58) Field of Classification Search
USPC ..... 200/5, 6 A, 6 R, 5 A, 5 R
See application file for complete search history.

(56) References Cited

FOREIGN PATENT DOCUMENTS

| | | | |
|---|---|---|---|
| KR | 1998-0070244 | A | 10/1998 |
| KR | 10-2006-0097148 | A | 9/2006 |
| KR | 10-2009-0004471 | A | 1/2009 |
| KR | 10-2011-0054656 | A | 5/2011 |
| KR | 2011-0094792 | A | 8/2011 |

OTHER PUBLICATIONS

KIPO Notice of Allowance for Patent Application No. 10-2010-0058959 which corresponds to U.S. Appl. No. 13/158,400.

*Primary Examiner* — Briggitte R Hammond
(74) *Attorney, Agent, or Firm* — LRK Patent Law Firm

(57) ABSTRACT

A multi-function switch assembly configured to implement a push switch function is provided. A structure for operating pivot switches of the multi-function switch assembly includes a Printed Circuit Board (PCB) disposed between upper and lower casings coupled together to face each other, push switches and rotary switches mounted on the PCB, pivot switches mounted on a bottom of the PCB, a pair of sliders disposed to cross each other at a bottom of the lower casing and configured to laterally ground and operate the pivot switches in eight directions while operating in conjunction with a manipulation direction of the actuation lever, and alignment means configured to elastically support at least one of bottoms of the pair of sliders so that restoring force of a neutral state is generated.

4 Claims, 6 Drawing Sheets

STRUCTURE FOR OPERATING PIVOT SWITCHES OF MULTI-FUNCTION SWITCH ASSEMBLY

CROSS-REFERENCE TO RELATED APPLICATION

Priority to Korean patent application number 10-2010-0058959 filed on Jun. 22, 2010, the entire disclosure of which is incorporated by reference herein, is claimed.

BACKGROUND OF THE INVENTION

1. Field of the Invention

The present invention relates to a multi-function switch assembly configured to implement a push switch function, a rotary switch function, and a pivot switch function at the same time and, more particularly, to a structure for operating the pivot switch of a multi-function switch assembly, which is capable of improving a feeling of manipulation of the pivot switch and also preventing interference with other switch functions.

2. Description of the Related Art

In general, a multi-function switch apparatus is applied to navigation systems or audio systems for vehicles and configured to operate several switches using one switch apparatus.

This multi-function switch apparatus includes a switch of a joystick method, a switch of a push method, and a switch of a rotary method which are integrated into one set.

FIG. 1 is a cross-sectional view showing a conventional multi-function switch apparatus. The conventional multi-function switch apparatus is described below with reference to FIG. 1.

The operation of a push switch is first described. When a push/joystick knob 1 placed at the top is pressed in a vertical direction, a first shaft 5 placed at the center of a switch casing 3 descends and presses a second shaft 7. At this time, push points of contact 9 come in contact with switch terminals provided in a PCB 11 by means of displacement that the second shaft 7 is moved, so that the push switch is turned on.

The operation of a joystick switch is described below. When the push/joystick knob 1 is moved in eight directions around the middle portion of the knob 1, such as the front, back, left, right, and diagonal directions, a joystick lever 13 disposed around the first shaft 5 in a dual-shaft structure is inclined and moved in the same direction as the push/joystick knob. At this time, four push units 15 extended from the joystick lever 13 in four directions press four pushers 17 and press one or two of the four push points of contact at the same time. Accordingly, the joystick switch is operated.

In other words, when the push/joystick knob 1 is moved in the up, down, left, or right direction, two of the four push points of contact are pressed at the same time. When the push/joystick knob 1 is moved in the diagonal direction, one of the four push points of contact is pressed. Accordingly, the joystick switch is operated.

Meanwhile, a detent equipment 19 is provided in the circumference of the joystick lever 13 on the upper side thereof and configured to perform both a position determination function and a return function when the joystick switch is operated.

The operation of a rotary switch is described below. When a rotary knob 21 disposed below the push/joystick knob 1 is rotated, a rotary body 23 is rotated along with the rotary knob 21, thereby changing a rotary switch 25. Accordingly, the rotary switch is operated.

The above conventional multi-function switch apparatus is configured to include several switches of the joystick method, the push method, and the rotary method and is manipulated in various ways.

In the conventional multi-function switch apparatus, however, means for transferring the manipulation force of the push/joystick knob 1 is configured to have the dual-shaft structure in which the first shaft 5 and the joystick lever 13 are separated from each other. Accordingly, the conventional multi-function switch apparatus is problematic in that the switch operation of the joystick method and the switch operation of the push method are complicated and the number of components is increased.

In particular, the push units 15 of the joystick lever 13 are lengthily extended around a radius in which the shaft 5 is a central axis in order to press the pushers 17. The push units must have sufficient stiffness in order to transfer the manipulation force to the pushers 17. To this end, the entire joystick lever 13 is made of metal material.

However, the joystick lever 13 made of metal material is problematic in that it increases the weight of the switch apparatus and also raises the manufacturing cost of the switch apparatus.

Furthermore, in the conventional apparatus, the push units 15 and the pushers 17 are disposed in eight directions (that is, the east, the west, the south, the north, the northeast, the southeast, the southwest, and the north-west directions), respectively. Accordingly, the conventional apparatus is problematic in that the construction is complicated, assembly is poor, and the manufacturing cost is raised owing to an increase of the number of components.

Furthermore, the conventional apparatus is configured to receive the restoring force of the joystick lever 13 through the manipulation force of the pushers 17. In other words, there is a problem in that the pushers 17 are frequently broken because excessive manipulation force of the joystick lever 13 is transferred through the pushers 17 without change. The pusher 17 is a kind of a switch and limited to a structural design change in order to increase elasticity or stiffness. Accordingly, the conventional apparatus has a problem in that a feeling of manipulation of the pivot switch of the joystick lever 13 is low.

Furthermore, the conventional apparatus is problematic in that the push points of contact 9 malfunction because the first shaft 5 descends and interferes with the second shaft 7 when the pivot switch of the joystick lever 13 is operated.

SUMMARY OF THE INVENTION

Accordingly, the present invention has been made in view of the above problems occurring in the prior art, and it is an object of the present invention to simplify a switch structure by simultaneously implementing a push switch function, a rotary switch function enabling rotation of 360°, and a joystick switch function enabling a pivot operation in eight directions by using an actuation lever having a single structure.

Another object of the present invention is to prevent interference in a vertical direction between the actuation lever and a slider when a pivot switch is manipulated, and improve a feeling of manipulation, facilitate the manipulation of the switch, and prevent interference with the rotary switch function or the push switch function by providing only restoring force in a horizontal direction through alignment means, thereby preventing a malfunction problem.

According to an embodiment of the present invention, the above objects may be achieved by a structure for operating pivot switches of the multi-function switch assembly includes a Printed Circuit Board (PCB) disposed between upper and lower casings coupled together to face each other, push switches and rotary switches mounted on the PCB, pivot switches mounted on a bottom of the PCB, a pair of sliders disposed to cross each other at a bottom of the lower casing and configured to laterally ground and operate the pivot switches in eight directions while operating in conjunction with a manipulation direction of the actuation lever, and alignment means configured to elastically support at least one of bottoms of the pair of sliders so that restoring force of a neutral state is generated.

The alignment means may include an elastic member received in the lower casing and a pin member configured to descend and ascend in a vertical direction in a state in which elastic support force of the elastic member is supplied to the pin member.

The structure may further include a cam groove formed at the bottom of each of the sliders and configured to come in contact with the top end of the pin member so that the pin member is guided.

The cam groove may include a neutral portion of a hemispheric shape formed at a center of the cam groove, a switch-on unit formed at a start portion curved and extended in a horizontal direction in a circumference of the neutral portion and configured to have the switches turned on, and a switch fixing unit extended at an end portion further extended from the switch-on unit in the horizontal direction and fixed in an on state.

BRIEF DESCRIPTION OF THE DRAWINGS

Further objects and advantages of the invention can be more fully understood from the following detailed description taken in conjunction with the accompanying drawings in which.

DETAILED DESCRIPTION OF EMBODIMENTS

Some exemplary embodiments of the present invention will now be described in detail with reference to the accompanying drawings.

Figure 1:
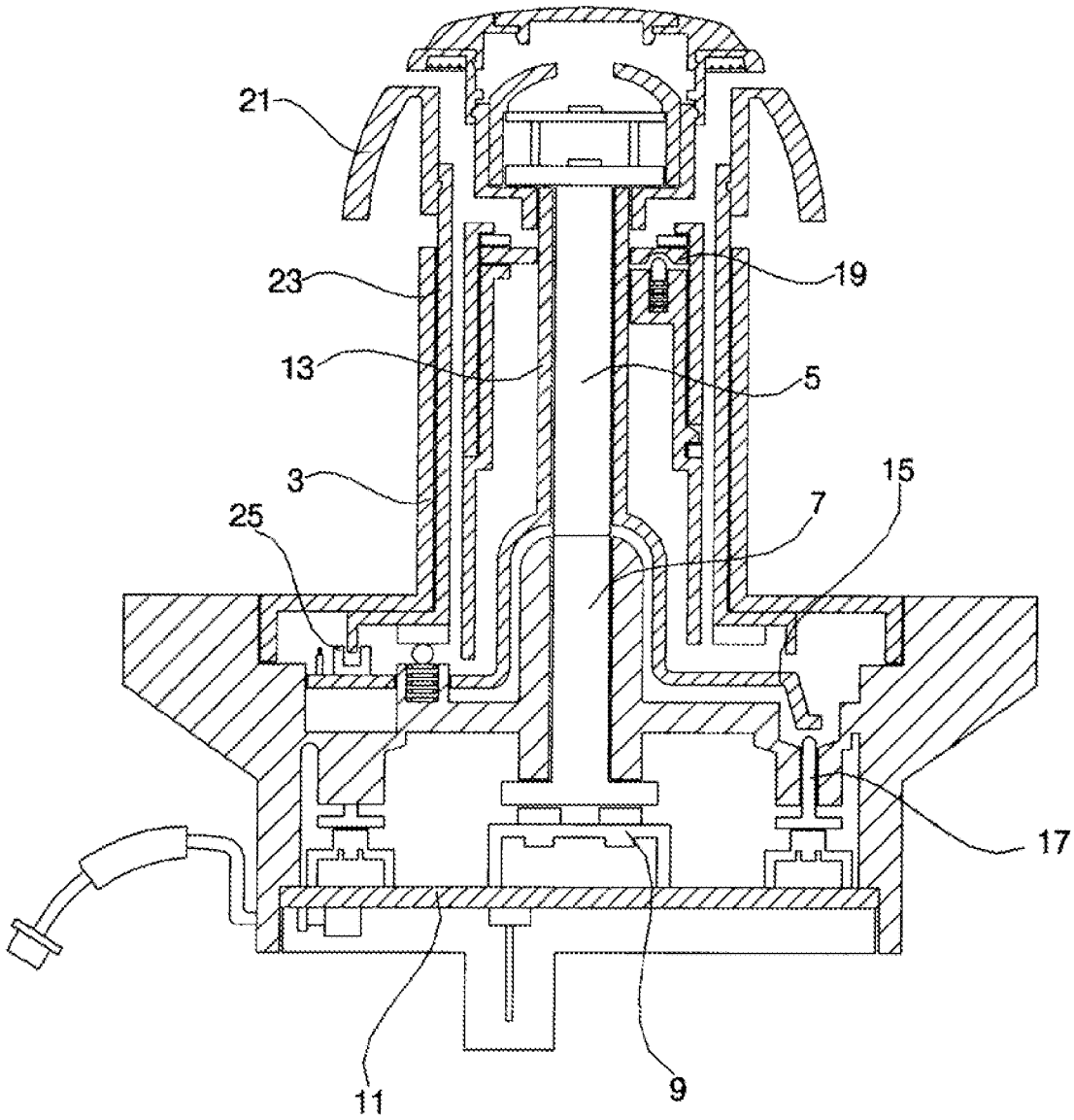
FIG. 1 RELATED ART
FIG. 1 is a cross-sectional view showing a conventional multi-function switch apparatus.
Figure 2:
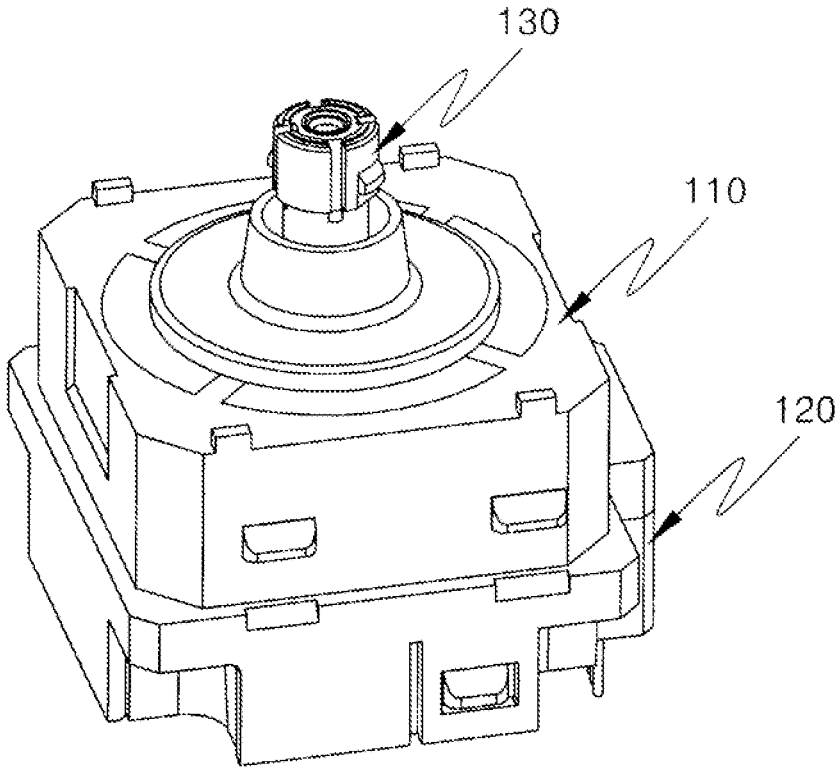
FIG. 2 is a perspective view showing the structure of a multi-function switch assembly according to an embodiment of the present invention.
Figure 3:
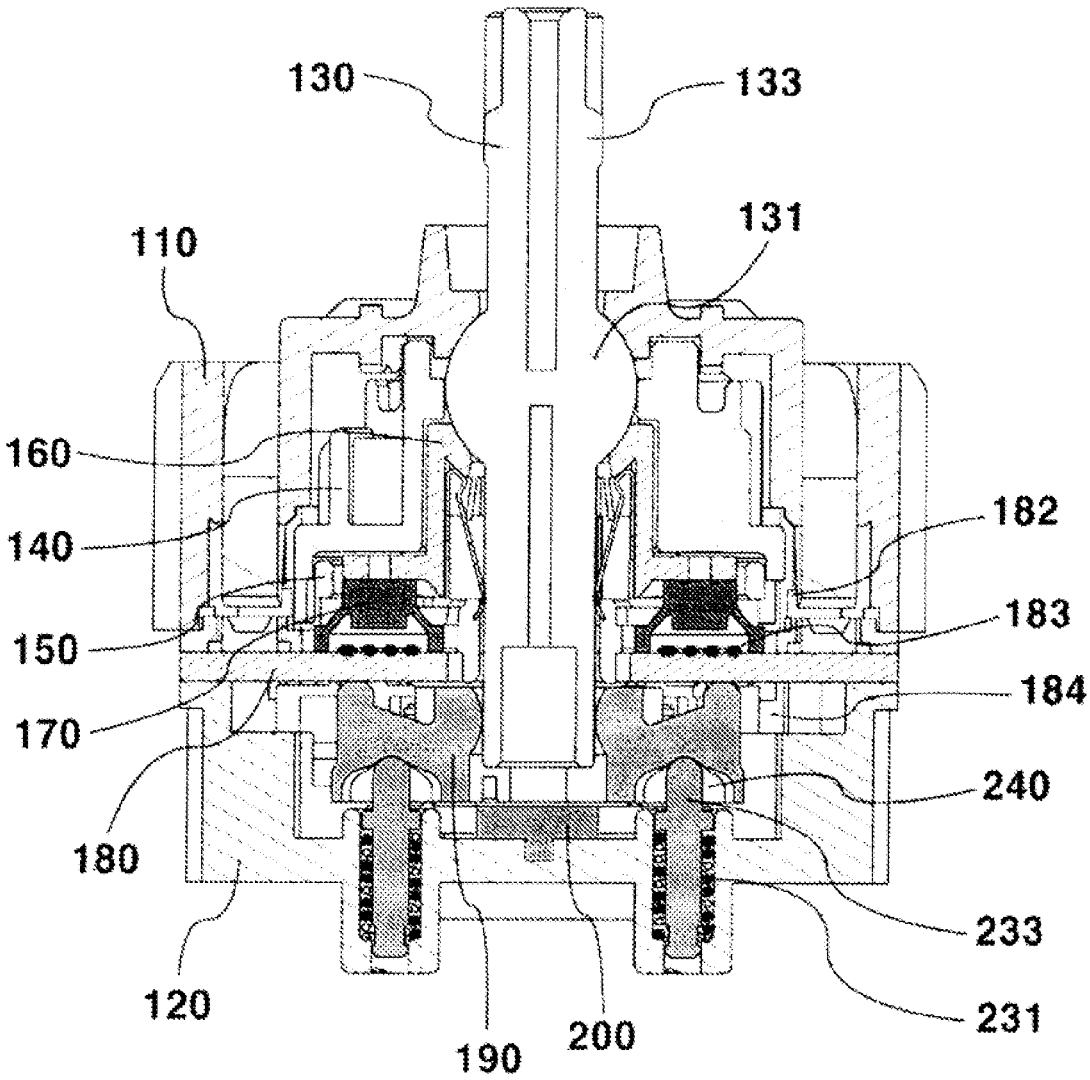
FIG. 3 is a cross-sectional view showing the internal structure of the multi-function switch assembly according to the embodiment of the present invention.
Figure 4:
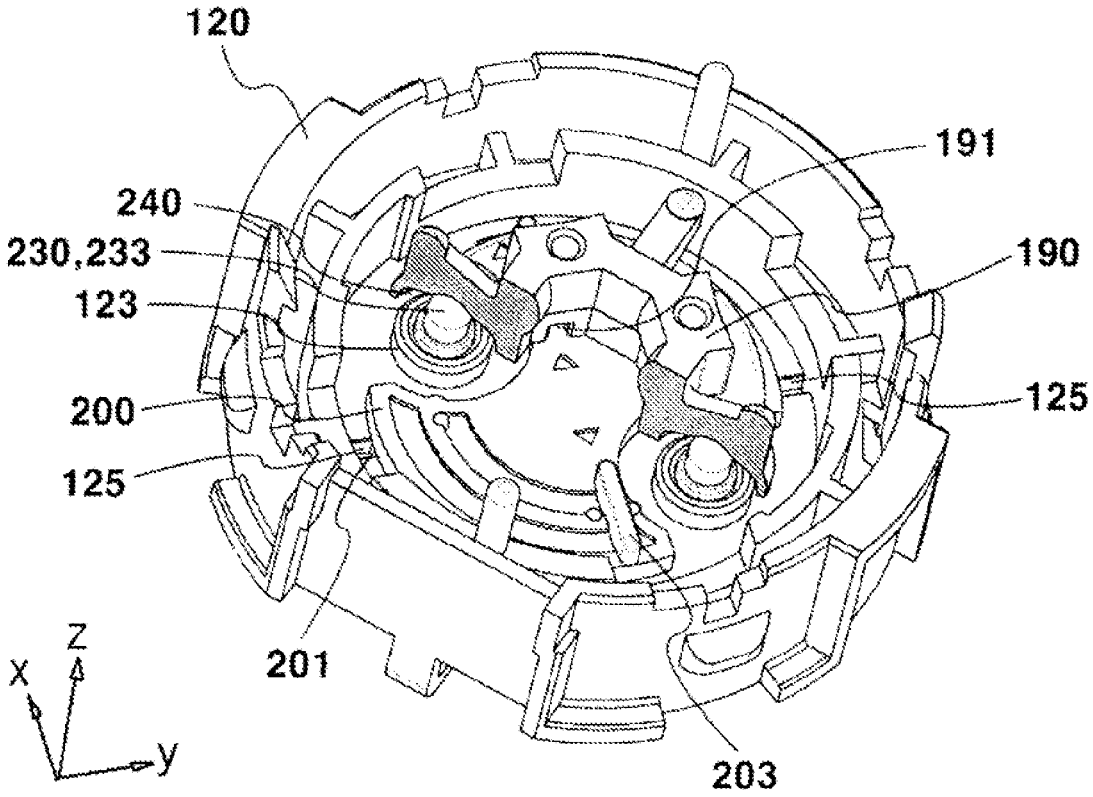
FIG. 4 is a perspective view showing the integral structure of the multi-function switch assembly according to the embodiment of the present invention.

As shown in FIGS. 2 to 4, a multi-function switch assembly of the present invention is equipped with upper and lower casings 110 and 120 which are coupled together to face each other.

An actuation lever 130 is configured to penetrate the upper casing 110 and the lower casing 120 from the top of the upper casing 110 toward the bottom of the lower casing 120 and connected to the upper and lower casings 110 and 120. A rotation holder 140 is axially connected to the actuation lever 130 on the lower side of the upper casing 110 and rotated 360° when the actuation lever 130 is rotated.

A fixing holder 150 is fixed between the upper and lower casings 110 and 120 under the rotation holder 140 and configured to support the rotary motion of the rotation holder 140. A push holder 160 is axially connected to the center of the fixing holder 150 and configured to slide in a vertical direction while operating in conjunction with the pressing manipulation of the actuation lever 130.

A switch cover 170 is disposed under the push holder 160 and is operated in conjunction with the pressing manipulation of the push holder 160. A Printed Circuit Board (PCB) 180 is disposed under the switch cover 170 and is configured to have the actuation lever 130 penetrate therethrough. First and second sliders 190 and 200 are sequentially stacked over the lower casing 120 under the PCB 180, axially connected to a lower portion of the actuation lever 130, and configured to slidably move in the x-axis direction and the y-axis direction, respectively, while operating in conjunction with the eight-direction pivot movement of the actuation lever 130.

Push switches 183 and rotary switches 182 are mounted on the PCB 180 provided between the upper and lower casings 110 and 120 assembled together. Pivot switches 184 are mounted on the bottom of the PCB 180.

Furthermore, the first and the second sliders 190 and 200 are disposed to cross each other at the bottom of the lower casing 120 in order to operate the pivot switches 184 in the eight directions in a lateral and ground way, while operating in conjunction with the manipulation direction of the actuation lever 130.

The first and the second sliders 190 and 200 are sequentially stacked over the lower casing 120 under the PCB 180, and the bottom of the actuation lever 130 is configured to axially penetrate the center of the first slider 190 and connected to the first slider 190.

Furthermore, the first slider 190 is railed and connected in such a way as to slidably move in the x-axis direction from the top of the second slider 200. The second slider 200 is railed and connected in such a way as to slidably move in the y-axis direction from the top of the lower casing 120.

To this end, guide rails 203 and 201 are formed on the upper and lower portions of the second slider 200 and configured to be orthogonal to each other in the x- and y-axis directions. Rail grooves 191 and 125 are formed at the bottom of the first slider 190 and at the top of the lower casing 120, respectively, and are coupled to the guide rails 203 and 201 in such a way to face each other.

That is, the first slider 190 is moved according to x- and y-axis coordinates in the manipulation direction of the actuation lever 130 and configured to ground the pivot switches 184 disposed in the movement direction and generate a signal.

Here, the first slider 190 may generate a new ground signal by grounding two signals at once when moving in the northeast, southeast, southwest, and north-west directions.

According to the present invention, the eight-direction joystick switch signals can be generated according to the above manipulation method.

In the present invention, a plurality of alignment means 230 may be installed to elastically support at least one of the bottoms of the pair of sliders 190 and 200 so that restoring force of a neutral state is generated. The alignment means 230 may include an elastic member 231 received in the lower casing 120 and a pin member 233 configured to ascend or descend in the vertical direction in that state in which it has been supplied with the elastic support force of the elastic member 231.

The elastic member 231 may be a kind of a coil spring. An accommodation unit 123 for accommodating the elastic member 231 and the pin member 233 is disposed in the lower casing 120.

A cam groove 240 is formed at the bottom of the first slider 190 and is brought in contact with the top end of the pin member 233, thereby guiding the pin member 233. The cam groove 240 may also be installed in the second slider 200. The structure of the cam groove 240 is described below. The cam groove 240 includes a neutral portion 241 of a hemispheric shape formed at the center thereof, a switch-on unit 243 formed at a start portion curved and extended in the horizontal direction in the circumference of the neutral portion 241 and configured to have the switches turned on, and a switch fixing unit 245 extended at an end portion further extended from the switch-on unit 243 in the horizontal direction and fixed in an on state.

The operation of the multi-function switch assembly configured as above according to the present invention is described below.

The multi-function switch of the present invention has the push switch function, the rotary switch function enabling rotation of 360°, and the joystick switch function enabling the pivot operation in the eight directions by using the actuation lever.

The rotary switch function is first described below. When the actuation lever 130 is rotated by grasping a handle 133, rotating force of the actuation lever 130 is transferred to the rotation holder 140, so that the rotation holder 140 is rotated in conjunction with the actuation lever 130.

At this time, a plurality of signal patterns having irregularities is formed at the bottom of the rotation holder 140. The signal patterns pass through the rotary switches 182, formed of a kind of optical sensors and disposed on the PCB 180, thus generating signals according to the form of irregularities.

The push switch function is described below. When the handle 133 of the actuation lever 130 is pressed in the vertical direction, the push holder 160 descends in conjunction with the movement of the actuation lever 130.

At this time, the sphere 131 of the actuation lever 130 is inserted into the middle portion of the push holder 160, being capable of transferring manipulation force in the vertical direction to the push holder 160.

The push holder 160 descends along with the actuation lever 130, presses the underlying switch cover 170, and grounds the push switch 183 installed on the PCB 180, thus generating signals.

The pivot switch function is described below. When the actuation lever 130 is pivoted and manipulated in the eight directions (that is, the east, the west, south, the north, the southeast, the north-west, the southwest, and the northeast directions), the first slider 190 and the second slider 200 axially connected to the bottom of the body of the actuation lever 130 slide and move in the eight directions while operating in conjunction with the actuation lever 130.

At this time, when the first slider 190 is moved in the eight directions, the first slider 190 comes in contact with the pivot switches 184 (that is, a kind of detector switches installed in the PCB 180), thus generating signals.

Figure 5A:
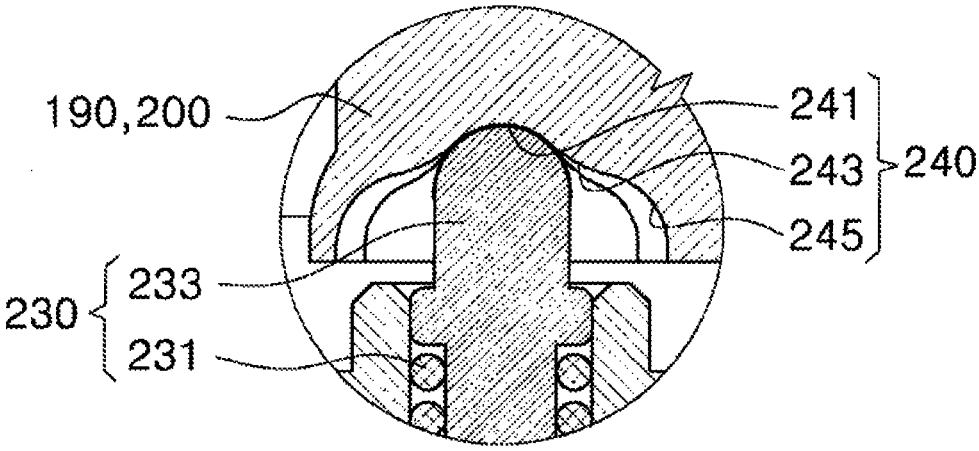
FIGS. 5A to 5C are schematic diagrams sequentially examples in which alignment means according to an embodiment of the present invention is operated.

An operating structure of the alignment means 230 according to the present invention is described below. FIG. 5A is a diagram showing that the actuation lever 130 is a neutral state. In FIG. 5A, the pin member 233 of the alignment means 230 upwardly supports the neutral portion 241 of the cam groove 240 by means of elastic support force of the elastic member 231.

Figure 5B:
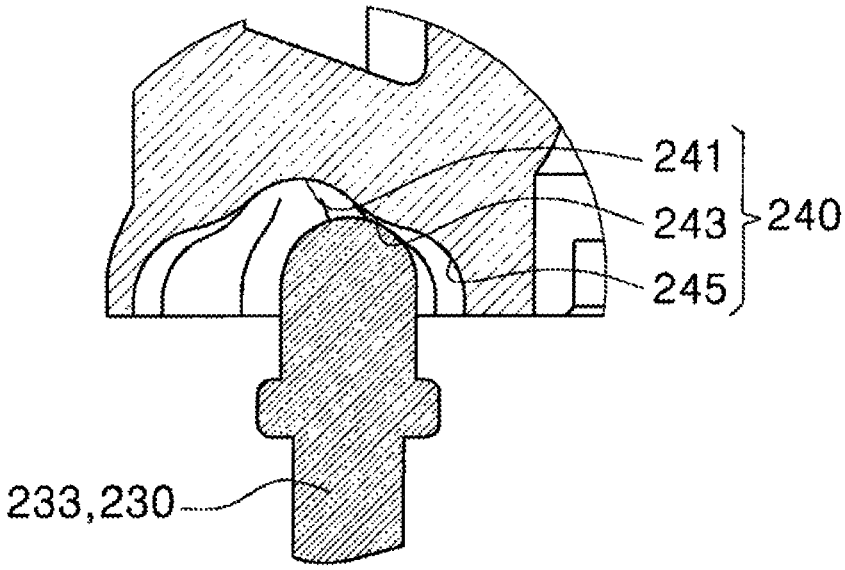

In the above neutral state, when a user manipulates the actuation lever 130 in a joystick way, the pivot switches 184 of the eight directions are grounded, thereby generating signals. Here, as shown in FIG. 5B, the switch-on unit 243 is formed in the circumference of the neutral portion 241 and configured to have the switches turned on at the start portion curved and extended in the horizontal direction. When the pin member 233 is pressed in a downward direction according to the position of the switch-on unit 243, the pin member 233 is slightly put on the switch-on unit 243. When the hand is released from the actuation lever 130, the pin member 233 returns to its neutral position according to the curve of the cam groove 240.

Figure 5C:
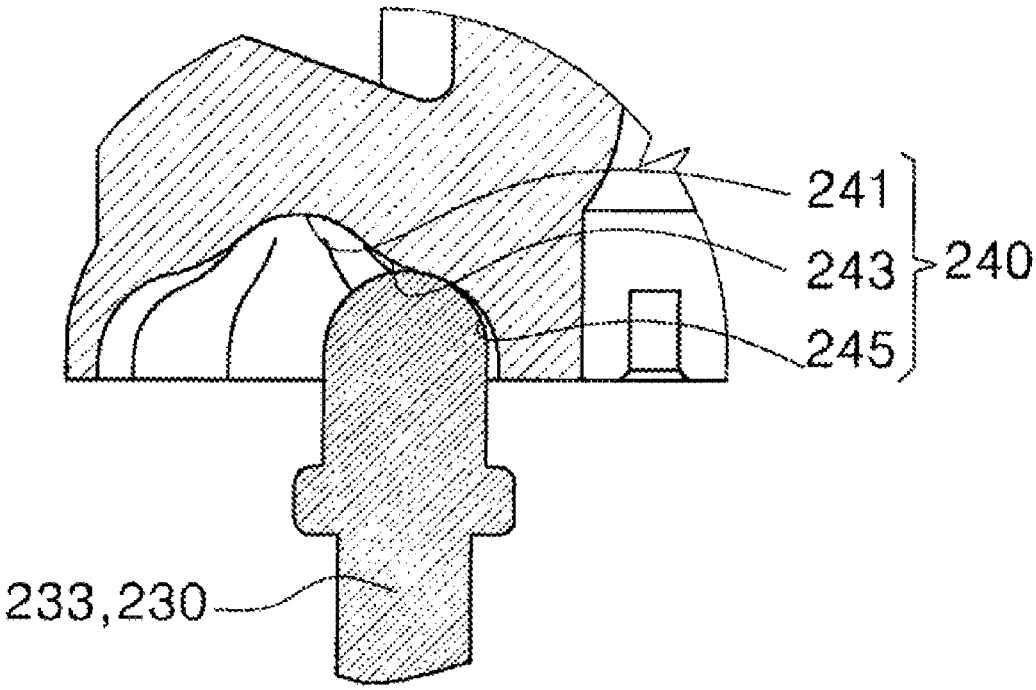

However, as shown in FIG. 5C, when the actuation lever 130 is further moved so that the pin member 233 is placed in the switch fixing unit 245 formed at the end portion further extended from the switch-on unit 243 in the horizontal direction, the switches may remain turned on although the hand is released from the actuation lever 130.

In this state, the actuation lever 130 may be returned to its neutral position by external force.

The multi-function switch assembly of the present invention having the above construction and operation can simplify the switch structure by implementing the push switch function, the rotary switch function enabling rotation of 360°, and the joystick switch function enabling the pivot operation in the eight directions by using the actuation lever having a single structure.

Furthermore, according to the present invention, there is no interference between the actuation lever 130 and the sliders 190 and 200 in the vertical direction when the pivot switches are manipulated, and only the restoring force of the alignment means in the horizontal direction is provided. Accordingly, there are advantages in that a feeling of manipulation can be improved, the switches can be easily manipulated, and a malfunction problem can be prevented because there is no interference with the rotary switch function or the push switch function.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A structure for operating pivot switches of a multi-function switch assembly, the structure comprising:

a Printed Circuit Board (PCB) disposed between upper and lower casings coupled together to face each other;

push switches and rotary switches mounted on the PCB;

pivot switches mounted on a bottom of the PCB;

a pair of sliders disposed to cross each other at a bottom of the lower casing and configured to laterally ground and operate the pivot switches in eight directions while operating in conjunction with a manipulation direction of an actuation lever; and alignment means configured to elastically support at least one of bottoms of the pair of sliders so that restoring force of a neutral state is generated.

2. The structure as claimed in claim 1, wherein the alignment means comprises:

an elastic member received in the lower casing; and a pin member configured to descend and ascend in a vertical direction in a state in which elastic support force of the elastic member is supplied to the pin member.

3. The structure as claimed in claim 2, further comprising a cam groove formed at the bottom of each of the sliders and configured to come in contact with a top end of the pin member so that the pin member is guided.

4. The structure as claimed in claim 3, wherein the cam groove comprises:

a neutral portion of a hemispheric shape formed at a center of the cam groove;

a switch-on unit formed at a start portion curved and extended in a horizontal direction in a circumference of the neutral portion and configured to have the switches turned on; and a switch fixing unit extended at an end portion further extended from the switch-on unit in the horizontal direction and fixed in an on state.

* * * * *